US010090097B2

(12) United States Patent
Ackermann et al.

(10) Patent No.: US 10,090,097 B2
(45) Date of Patent: Oct. 2, 2018

(54) HIGH VOLTAGE TRANSFORMER COMPRISING A COIL BOBBIN FOR CARRYING A HIGH VOLTAGE WINDING

(71) Applicant: KONINKLIJKE PHILIPS N.V., Eindhoven (NL)

(72) Inventors: Bernd Ackermann, Eindhoven (NL); Wolfgang Efftinge, Hamburg (DE); Albert Garcia Tormo, Eindhoven (NL); Christian Hattrup, Eindhoven (NL); Ralf Kröger, Hamburg (DE); Thomas Scheel, Eindhoven (NL); Peter Lürkens, Eindhoven (NL); Antonius Johannes Joseph Wismans, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 70 days.

(21) Appl. No.: 15/105,603

(22) PCT Filed: Dec. 11, 2014

(86) PCT No.: PCT/EP2014/077373
§ 371 (c)(1),
(2) Date: Jun. 17, 2016

(87) PCT Pub. No.: WO2015/091202
PCT Pub. Date: Jun. 25, 2015

(65) Prior Publication Data

US 2016/0314898 A1 Oct. 27, 2016

(30) Foreign Application Priority Data

Dec. 19, 2013 (EP) ..... 13198581

(51) Int. Cl.
*H01F 27/28* (2006.01)
*H01F 27/32* (2006.01)
*H05G 1/10* (2006.01)

(52) U.S. Cl.
CPC ..... *H01F 27/323* (2013.01); *H01F 27/28* (2013.01); *H01F 27/2823* (2013.01);
(Continued)

(58) Field of Classification Search
CPC ..... H01F 27/00–27/36
(Continued)

(56) References Cited

U.S. PATENT DOCUMENTS 4,514,712 A 4/1985 McDougal
4,814,733 A * 3/1989 Menge ..... H01F 27/027 336/198
(Continued)

FOREIGN PATENT DOCUMENTS

DE 4204092 A1 8/1993
GB 709361 5/1954
WO 2012080899 A1 6/2012

*Primary Examiner* — Tuyen Nguyen
(74) *Attorney, Agent, or Firm* — Larry Liberchuk

(57) ABSTRACT

A high voltage transformer (50) includes a magnetic core (5); a low voltage winding (10); a high voltage winding (20); at least one inner sleeve (30); and a coil bobbin (24) for carrying the high voltage winding (20). The coil bobbin (24) is configured to be arranged inside the at least one inner sleeve (30) and configured to be attached to the at least one inner sleeve (30) at an outer perimeter of the at least one inner sleeve (30). The coil bobbin (24) includes at least one field-control electrode (22), which is adapted to shape an electric field generated by the high voltage winding (20).

13 Claims, 3 Drawing Sheets

(52) U.S. Cl.
CPC ..... *H01F 27/2885* (2013.01); *H01F 27/325* (2013.01); *H05G 1/10* (2013.01)

(58) Field of Classification Search
USPC ..... 336/192, 196, 198, 200, 232, 220–223
See application file for complete search history.

(56) References Cited

U.S. PATENT DOCUMENTS

| | | | | |
|---|---|---|---|---|
| 5,225,803 | A | 7/1993 | Negle | |
| 5,847,518 | A * | 12/1998 | Ishiwaki | H01F 3/14 315/276 |
| 5,959,521 | A * | 9/1999 | Kohmura | H01F 27/40 336/192 |
| 7,571,868 | B2 | 8/2009 | Bayer | |
| 2006/0192648 | A1 | 8/2006 | Suzuki | |

* cited by examiner

HIGH VOLTAGE TRANSFORMER COMPRISING A COIL BOBBIN FOR CARRYING A HIGH VOLTAGE WINDING

CROSS-REFERENCE TO PRIOR APPLICATIONS

This application is the U.S. National Phase application under 35 U.S.C. § 371 of International Application No. PCT/EP2014/077373, filed on Dec. 11, 2014, which claims the benefit of European Patent Application No. 13198581.4, filed on Dec. 19, 2013. These applications are hereby incorporated by reference herein.

FIELD OF THE INVENTION

The invention relates to a coil bobbin for carrying a high voltage winding and a high voltage transformer comprising a corresponding coil bobbin.

BACKGROUND OF THE INVENTION

The spectral composition of the X-rays coming from an X-ray tube depends on the acceleration voltage of the electron beam. As the different sorts of tissue in a living body have different absorption properties depending on the energy of the X-rays, this effect can be used to differentiate between different tissue compositions and thus allow more specific diagnosis of various pathological situations. Ideally, in computed tomography every other frame can be taken with a different energy level and the type of tissue can be examined in addition to the standard 3D-picture.

WO 2012 080 899 A1 (US 2013/0251108) describes a power supply unit for an X-ray radiation source comprising a high voltage generator for providing a basic current for the operation of an X-ray tube, a waveform generator and a pulse transformer for providing superimposable voltage peaks and a control unit for generating a counterbalance at an input of the pulse transformer to prevent saturation effects. Providing different reference waveform patterns leads to the prevention of overshooting and ringing.

In the described solution, the acceleration voltage of the electron beam is the superposition of the DC voltage created by the main high voltage generator and a high voltage pulse pattern created by a control unit and waveform generator in conjunction with the pulse transformer. The waveform generator creates a pulse pattern at low voltages and high currents. The pulse transformer converts this to a pulse pattern at high voltages and low currents and superposes it with the high DC voltage of the main generator.

DE 42 04 092 A1 describes spool bodies used with coil chambers for coiled products e.g. high voltage transformers. A therein described spool body with at least one coil chamber is used for coiled products especially for high voltage transformers. The therein described passage between the chamber inner wall and the bottom of the chamber is adapted to the geometry of the coil.

The pulse transformer has to isolate the large voltage difference between the primary winding linked to the low voltage circuit of the waveform generator and the secondary winding linked to the high voltage circuit of the main generator. The operating frequency of the pulse transformer is determined by the duration of the pulse pattern defined by the application requirements outlined above. Therefore, it is not possible to reduce the size of the pulse transformer by increasing its operating frequency as can be done e.g. for the high voltage transformer in the main generator. Therefore, the high voltage isolation of the pulse transformer has to be designed with special care to avoid any unnecessary increase of its dimensions.

SUMMARY OF THE INVENTION

There may be a need to improve the setup of a high voltage generator.

These needs are met by the subject-matter of the independent claims. Further exemplary embodiments are evident from the dependent claims and the following description.

An aspect of the invention relates to a high voltage transformer comprising: a magnetic core; a low voltage winding; a high voltage winding; at least one inner sleeve; and a coil bobbin for carrying the high voltage winding, wherein the coil bobbin is configured to be arranged inside the at least one inner sleeve and configured to be attached to the at least one inner sleeve at an outer perimeter of the at least one inner sleeve; and wherein the coil bobbin comprises at least one field-control electrode, which is adapted to shape an electric field generated by the high voltage winding.

A further aspect of the invention relates to a coil bobbin for carrying a high voltage winding, the coil bobbin is configured to be arranged inside at least one inner sleeve and configured to be attached to the at least one inner sleeve at an outer perimeter of the at least one inner sleeve.

A further aspect of the invention relates to an X-ray system, comprising an X-ray tube and a high voltage transformer to supply the X-ray tube.

A further aspect of the invention relates to a high voltage test system comprising a high voltage transformer.

The bobbin carrying the high voltage winding is placed inside at least one closed sleeve. The bobbin is attached to the sleeve at its outer perimeter. If there is more than one sleeve, then neighboring sleeves are attached to each other at the outer perimeter of the smaller sleeve that is placed inside the larger sleeve.

The present invention allows minimizing the transformer volume by removing all plastic holders and spacers between the primary and the secondary windings, as well as using a labyrinth-like structure in the joints connecting upper and lower halves of the sleeves to maximize the surface distance.

Furthermore, field-control electrodes shape the electric field so that the peak amplitude is lower, thereby allowing reducing the thickness of the plastic parts.

According to an exemplary embodiment of the invention, the high voltage transformer comprises further at least two labyrinth seals, which are placed opposite to each other.

According to an exemplary embodiment of the invention, the high voltage transformer further comprises at least two insulating spring washers for retaining the sleeves carrying the high voltage winding.

According to an exemplary embodiment of the invention, the high voltage transformer further comprises a flange connected to an outer perimeter of the at least one inner sleeve for retaining the secondary coil bobbin carrying the high voltage winding.

According to an exemplary embodiment of the invention, the high voltage transformer further comprises a secondary coil bobbin, wherein the at least one field-control electrode is arranged on the faces of the secondary coil bobbin.

According to an exemplary embodiment of the invention, the high voltage transformer further comprises core edges, wherein the at least one field-control electrode is arranged on the core edges.

According to an exemplary embodiment of the invention, the high voltage transformer further comprises at least one insulating high voltage wire pipe.

According to an exemplary embodiment of the invention, the coil bobbin comprises further at least one field-control electrode, which is adapted to shape an electric field generated by the high voltage winding.

According to an exemplary embodiment of the invention, the coil bobbin is adapted for use in a high voltage transformer.

BRIEF DESCRIPTION OF THE DRAWINGS

A more complete appreciation of the invention and the attendant advantages thereof will be more clearly understood by reference to the following schematic drawings, which are not to scale, wherein.

DETAILED DESCRIPTION OF EMBODIMENTS

Figure 1:
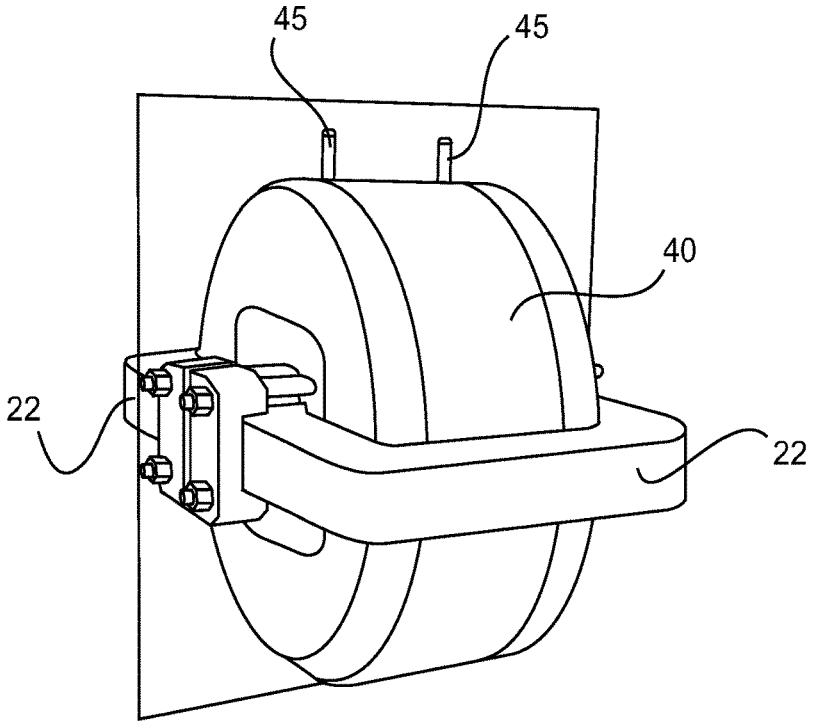
FIG. 1 shows a schematic perspective three-dimensional projection of a high voltage transformer according to an exemplary embodiment of the invention.

The illustration in the drawings is schematically and not to scale. In different drawings, similar or identical elements are provided with the same reference numerals.

Generally, identical parts, units, entities or steps are provided with the same reference symbols in the figures.

FIG. 1 shows a schematic perspective three-dimensional projection of a high voltage transformer according to an exemplary embodiment of the invention.

Figure 4:
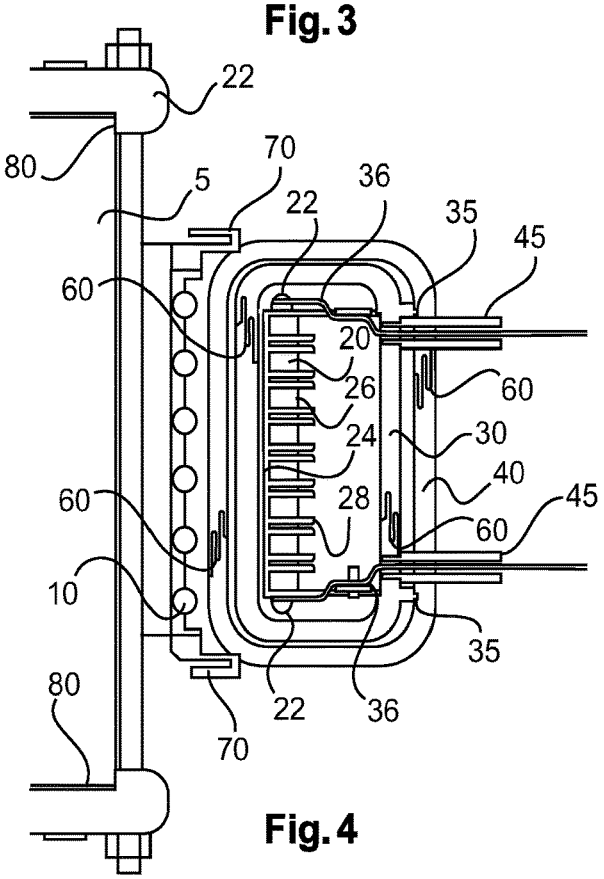
FIG. 4 shows a schematic cross section perpendicular to the core of a high voltage transformer according to an exemplary embodiment of the invention.

FIG. 1 shows a pulse transformer or high voltage transformer. FIG. 1 defines a perpendicular cross section of a high voltage transformer with respect to its core according to an exemplary embodiment of the invention, which is shown in FIG. 4. Aluminum shells acting as field-control electrodes 22 may cover the magnetic cores of the high voltage transformer. The outer sleeve 40 encloses the inner sleeve and the high voltage winding. The high voltage wire pipes 45 guide the connections of the high voltage winding away from the field control electrodes 22 covering the magnetic cores.

Figure 2:
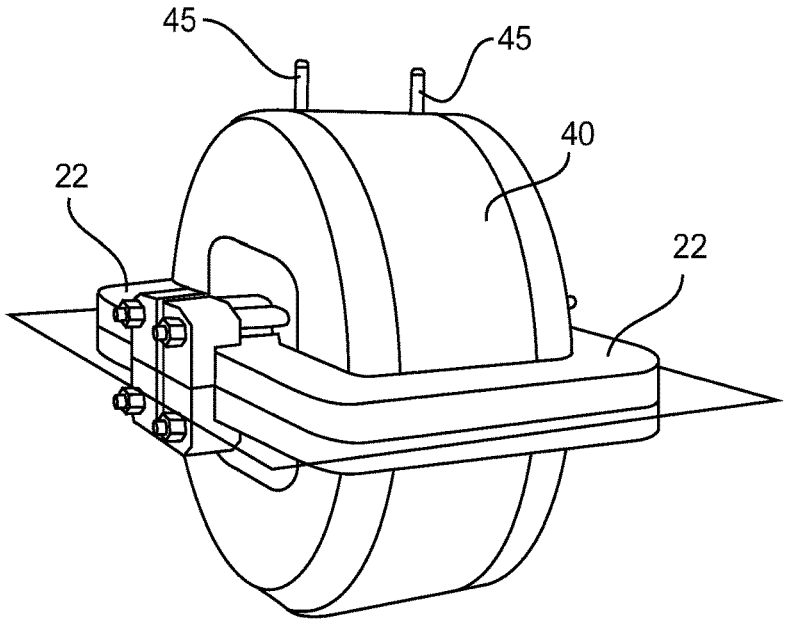
FIG. 2 shows a schematic perspective three-dimensional projection of a high voltage transformer according to a further exemplary embodiment of the invention.

FIG. 2 shows a schematic perspective three-dimensional projection of a high voltage transformer according to a further exemplary embodiment of the invention.

Figure 3:
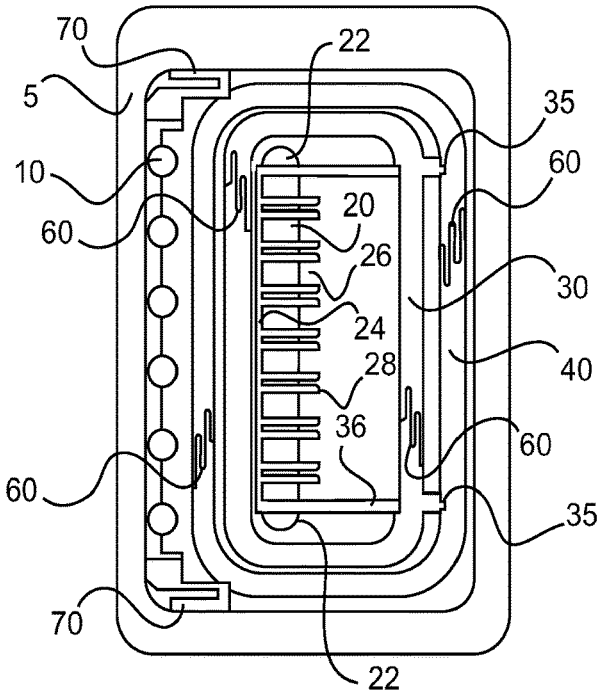
FIG. 3 shows a schematic cross section parallel to the core of a high voltage transformer according to an exemplary embodiment of the invention.

FIG. 2 shows a pulse transformer or high voltage transformer. FIG. 2 defines a parallel cross section of a high voltage transformer with respect to its core according to an exemplary embodiment of the invention, which is shown in FIG. 3. Aluminum shells acting as field-control electrodes 22 may cover the magnetic cores of the high voltage transformer. The outer sleeve 40 may enclose the inner sleeve and the high voltage winding. The high voltage wire pipes 45 guide the connections of the high voltage winding away from the field control electrodes 22 covering the magnetic cores.

FIG. 3 shows a schematic cross section parallel to the core of a high voltage transformer according to an exemplary embodiment of the invention.

FIG. 3 shows the attachment of the bobbin of the high voltage winding to the inner sleeve and of the inner sleeve to the outer sleeve, in a parallel two dimensional cross section. For simplification, only one half of the high voltage transformer is shown. The high voltage transformer may comprise: a magnetic core 5, a low voltage winding 10, a high voltage winding 20, at least one inner sleeve 30, and a coil bobbin 24 for carrying the high voltage winding 20.

Optionally, the magnetic core 5 is made of a soft magnetic material, e.g. ferromagnetic material and/or ferrimagnetic material. The magnetic core 5 may comprise iron or nickel or alloys of iron or nickel or ceramic oxides of metals.

The inner sleeve 30 may be fabricated from a plastic material or any other non-conductive synthetic or semi-synthetic solid material.

Optionally, the winding wire of the low voltage winding 10 and/or of the high voltage winding 20 is made of copper or a copper alloy or of aluminum or of an aluminum alloy, and the winding wire may coated with a very thin layer of insulation.

Optionally, in one embodiment of the invention, the coil bobbin 24 may be divided into multiple slots 26, so that the voltage difference within each slot becomes only a fraction of that between the terminals of the high voltage winding. Thin insulation slots 28 between winding slots avoid discharges going over the bobbin surface. These insulation slots may also be used to return the winding wire from the top of one slot to the bottom of the next slot.

The coil bobbin 24 may be configured to be arranged inside the at least one inner sleeve 30 and may be configured to be attached to the at least one inner sleeve 30 at an outer perimeter of the at least one inner sleeve 30.

The coil bobbin 24 may be fabricated from a plastic material or any other non-conductive synthetic or semi-synthetic solid material.

The coil bobbin 24 may comprise at least one field-control electrode 22, which is adapted to shape an electric field generated by the high voltage winding 20.

The magnetic core 5 may be a soft magnetic core.

The high voltage transformer may further comprise at least one outer sleeve 40.

The high voltage transformer may further comprise an attachment 35 of the at least one inner sleeve 30 to the at least one outer sleeve 40 and attachment or flange 36 of high voltage winding 20 to the at least one inner sleeve 30.

The high voltage transformer may further comprise at least one insulating high voltage wire pipe 45. The high voltage wire pipe 45 may be fabricated from a plastic material or any other non-conductive synthetic or semi-synthetic solid material. The high voltage transformer may further be fabricated by applying a press-fixture to the high voltage transformer assembly.

The high voltage transformer 50 may further comprise further at least two labyrinth seals 60, which are placed opposite to each other. The labyrinth seals 60 may be fabricated as structures in an upper half and in a lower half of the inner sleeve 30 or as structures in an upper half and in a lower half of the outer sleeve 40. The outer sleeve 40 may be fabricated from a plastic material or any other non-conductive synthetic or semi-synthetic solid material.

The high voltage transformer 50 may further comprise at least two insulating spring washers 70 for retaining the high voltage winding 20. The insulating spring washers 70 may be fabricated from a plastic material or any other non-conductive synthetic or semi-synthetic solid material.

FIG. 4 shows a schematic cross section perpendicular to the core of a high voltage transformer according to an exemplary embodiment of the invention. FIG. 4 shows the attachment of the bobbin of the high voltage winding to the inner sleeve and of the inner sleeve to the outer sleeve in the perpendicular two dimensional cross section. For simplification, only one half of the high voltage transformer is shown.

Figure 5:
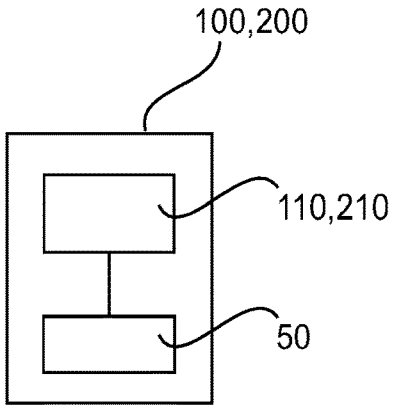
FIG. 5 shows an X-ray system or a high voltage system according to an exemplary embodiment of the invention.

FIG. 5 shows an X-ray system according to an exemplary embodiment of the invention.

An X-ray system 100 may comprise an X-ray tube 110 and a high voltage transformer 50 which is configured to supply the X-ray tube 110.

A high voltage test system 200 may comprise a high voltage transformer 50 which is configured to supply high voltage consumer 210.

Figure 6:
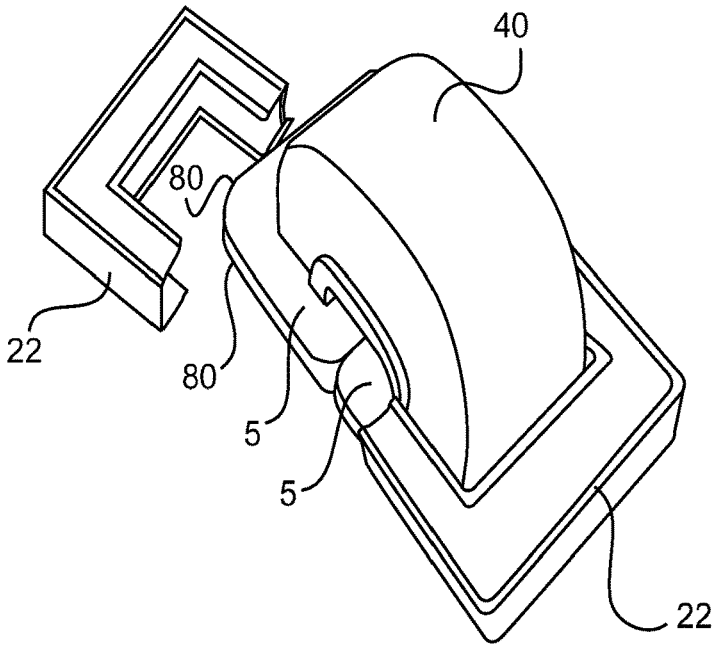
FIG. 6 shows a schematic perspective three-dimensional projection of a high voltage transformer according to a further exemplary embodiment of the invention.

FIG. 6 shows a schematic perspective three-dimensional projection of a high voltage transformer according to a further exemplary embodiment of the invention.

The high voltage transformer as shown in FIG. 6 comprises field-control electrodes 22 on core edges 80, aluminum shells covering the magnetic core 5, wherein the field-control electrodes 22 are arranged on the core edges 80.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art and practicing the claimed invention, from a study of the drawings, the disclosure, and the appended claims.

In the claims, the word "comprising" does not exclude other elements or steps, and the indefinite article "a" or "an" does not exclude a plurality. A single processor or controller or other unit may fulfil the functions of several items recited in the claims. The mere fact that certain measures are recited in mutually different dependent claims does not indicate that a combination of these measures cannot be used to advantage. Any reference signs in the claims should not be construed as limiting the scope.

LIST OF REFERENCE SIGNS

5 magnetic core
10 a low voltage winding
20 a high voltage winding
22 field-control electrode
24 coil bobbin
26 slot
28 insulation slot
30 inner sleeve
35 attachment
36 attachment (flange)
40 outer sleeve
45 high voltage wire pipe
50 high voltage transformer
60 labyrinth seal
70 insulating spring washer
80 core edge
100 X-ray system
110 X-ray tube
200 high voltage test system
210 high voltage consumer

The invention claimed is:

1. A high voltage transformer comprising:
a magnetic core;
a low voltage winding;
a high voltage winding;
an inner closed sleeve defining a first closed volume;
an outer closed sleeve defining a second closed volume and enclosing the inner closed sleeve in the second closed volume;
a coil bobbin carrying the high voltage winding, the coil bobbin being arranged inside the inner closed sleeve in the first closed chamber and attached to the inner closed sleeve at an outer perimeter of the inner closed sleeve; and
wherein the coil bobbin comprises at least one field-control electrode, which is adapted to shape an electric field generated by the high voltage winding.

2. The high voltage transformer according to claim 1, further including:
a flange configured to attach the coil bobbin in a spaced relationship to the inner closed sleeve.

3. The high voltage transformer according to claim 1, further including:
at least two insulating spring washers mounted between the low voltage winding or the core and the outer sleeve to maintain a spaced relationship between the outer sleeve and the low voltage winding to maintain spacing between the low voltage winding and the high voltage winding.

4. The high voltage transformer according to claim 3, further including:
a flange connected to an outer perimeter of the inner closed sleeve for retaining the high voltage winding inside the inner closed sleeve.

5. The high voltage transformer according to claim 1, wherein the at least one field-control electrode is arranged on faces of the coil bobbin.

6. The high voltage transformer according to claim 5, including:
attachments mounting the inner closed sleeve in a spaced relationship inside the outer closed sleeve.

7. The high voltage transformer according to claim 1, further including:
at least one insulating high voltage wire pipe.

8. A coil bobbin assembly for a high voltage transformer comprising:
a first closed sleeve defining a first interior volume; and
a coil bobbin mounted in the first interior volume by being attached to the first closed sleeve at an outer perimeter of the first closed sleeve.

9. The coil bobbin assembly according to claim 8, further including:
at least one field-control electrode, configured to shape an electric field generated by the high voltage winding.

10. The coil bobbin according to claim 8, further including:
a second closed sleeve defining a second interior volume, an outer periphery of the first closed sleeve being attached to the second closed sleeve to mount the first closed sleeve inside the second interior volume in a spaced relationship to the second closed sleeve.

11. An X-ray system, comprising an X-ray tube and the high voltage transformer according to claim 1.

12. A high voltage test system comprising a high voltage transformer according to claim 1.

13. A high voltage transformer comprising:

a magnetic core;

a low voltage winding disposed around a portion of the magnetic core;

an outer tubular closed sleeve disposed around the low voltage winding, the outer tubular closed sleeve defining an outer annular interior volume;

an inner tubular closed sleeve disposed inside the outer annular interior volume of the outer tubular closed sleeve, the inner tubular closed sleeve defining an inner annular interior volume;

attachments attaching an outer periphery to the outer tubular closed sleeve in a spaced relationship the inner closed sleeve;

a coil bobbin disposed in the inner annular interior volume, the bobbin including a flange connected to an outer perimeter of the inner tubular closed sleeve to support the coil bobbin in the inner annular interior volume;

a high voltage winding carried by the coil bobbin; and at least one field control electrode carried by the coil bobbin and configured to shape an electric field generated by the high voltage winding.

* * * * *